US006946960B2

(12) United States Patent
Sisson et al.

(10) Patent No.: US 6,946,960 B2
(45) Date of Patent: Sep. 20, 2005

(54) ACTIVE TAMPER DETECTION SYSTEM FOR ELECTRONIC MODULES

(75) Inventors: Robert Sisson, Shelton, CT (US); Ralph A. Rapillo, Trumbull, CT (US); George M. Macdonald, Stamford, CT (US)

(73) Assignee: Pitney Bowes Inc., Stamford, CT (US)

( * ) Notice: Subject to any disclaimer, the term of this patent is extended or adjusted under 35 U.S.C. 154(b) by 127 days.

(21) Appl. No.: 10/248,217

(22) Filed: Dec. 28, 2002

(65) Prior Publication Data

US 2004/0124980 A1 Jul. 1, 2004

(51) Int. Cl.[7] ..... G08B 21/00
(52) U.S. Cl. ..... 340/540; 340/568.1; 340/686.1
(58) Field of Search ..... 340/540, 573.1, 340/604, 691.7, 568.1, 686.1; 342/357.09, 386; 362/352, 96, 253

(56) References Cited

U.S. PATENT DOCUMENTS 4,586,456 A * 5/1986 Forward ..... 116/210
4,704,934 A * 11/1987 Nosrati ..... 84/94.2
5,222,740 A * 6/1993 Wu et al. ..... 273/371
5,858,500 A * 1/1999 MacPherson ..... 428/68
6,195,039 B1 * 2/2001 Glass, Jr. ..... 342/357.09
6,371,638 B1 * 4/2002 Zingale et al. ..... 362/565
6,661,344 B2 * 12/2003 Bowling ..... 340/573.3
2002/0084090 A1 7/2002 Farquhar et al. ..... 174/52.4

FOREIGN PATENT DOCUMENTS

GB 2273379 A * 6/1994 ..... G08B/21/00

* cited by examiner

*Primary Examiner*—Anh V. La
(74) *Attorney, Agent, or Firm*—George M. Macdonald; Steven J. Shapiro; Angelo N. Chaclas

(57) ABSTRACT

Tamper detecting enclosures are described. In one configuration, an inflated balloon at least partially surrounds a module in an enclosure and biases at least one normally opened switch into a closed position during normal operation. If an attacker attempts to attack the enclosure, the balloon should at least partially deflate and cause the switch to return to its normally opened position thereby detecting the attack. In another configuration, the balloon is adhered to the inside wall of the outer enclosure.

20 Claims, 4 Drawing Sheets

ACTIVE TAMPER DETECTION SYSTEM FOR ELECTRONIC MODULES

BACKGROUND OF INVENTION

The illustrative embodiments described in the present application are useful in systems including those for tamper detection and more particularly are useful in systems including those for tamper detection and response in electronic modules.

Electronic modules may contain sensitive data that requires protection from unauthorized access. For example, an electronic module may include memory for storing an indication of value such as an electronic vault containing a value of postage. Postage meters containing postage vaults are available from Pitney Bowes Inc. of Stamford Conn.

It may be advantageous for value vaults to be designed to adequately deal with the threat of tampering and fraud in which an attacker may attempt to increase the value stored in the vault without purchasing the postage. An electronic module may contain the only record for a value figure. Such a record may represent an electronic form of value that is equivalent to cash for certain applications such as storing an amount of credit purchased to be used in a vending machine or at a Laundromat. Standards have been developed to test and characterize the ability of such modules to detect and respond to tamper attacks.

Tamper respondent enclosures have been described including certain aspects of tamper respondent enclosures described in U.S. Pat. No. 5,858,500, issued Jan. 12, 1999 to MacPherson, which is incorporated herein by reference. U.S. Pat. No. 5,858,500 describes the use of flexible tamper respondent laminates. U.S. patent application Publication Ser. No. 2002/0,084,090, published Jul. 4, 2002, describes tamper-responding enclosures and is incorporated herein by reference. The prior tamper respondent enclosures utilize a system of wire meshes and wraps surrounding the protected electronics. Low-security devices have been designed with a switch on a door that is used to determine if a clamshell enclosure is opened.

SUMMARY OF INVENTION

The present application describes several illustrative embodiments for a tamper detecting enclosures, two of which are summarized here for illustrative purposes. In one embodiment, an at least partially inflated balloon in an enclosure biases at least one switch into a closed position during normal operation. If an attacker attempts to attack the device, the balloon at least partially deflates and causes the switch to return to its open position thereby detecting the attack. In another embodiment, a balloon at least partially surrounds a module and at least a portion of the outer surface of the balloon is adhered to the inside wall of the outer enclosure.

DETAILED DESCRIPTION

Illustrative embodiments of an active tamper detection system are described for modules such as electronics modules incorporating sensitive encryption key information. However, the embodiments may be applied to other enclosures as well.

The U.S. government National Institute of Standards and Technology has published security standards for cryptographic modules. Federal Information Processing Standards Publication FIPS 140-2 enumerates 4 classes of devices with increasing ability to thwart attacks from Level 1 through Level 4. Such sensitive modules are likely to come under attack.

Figure 1:
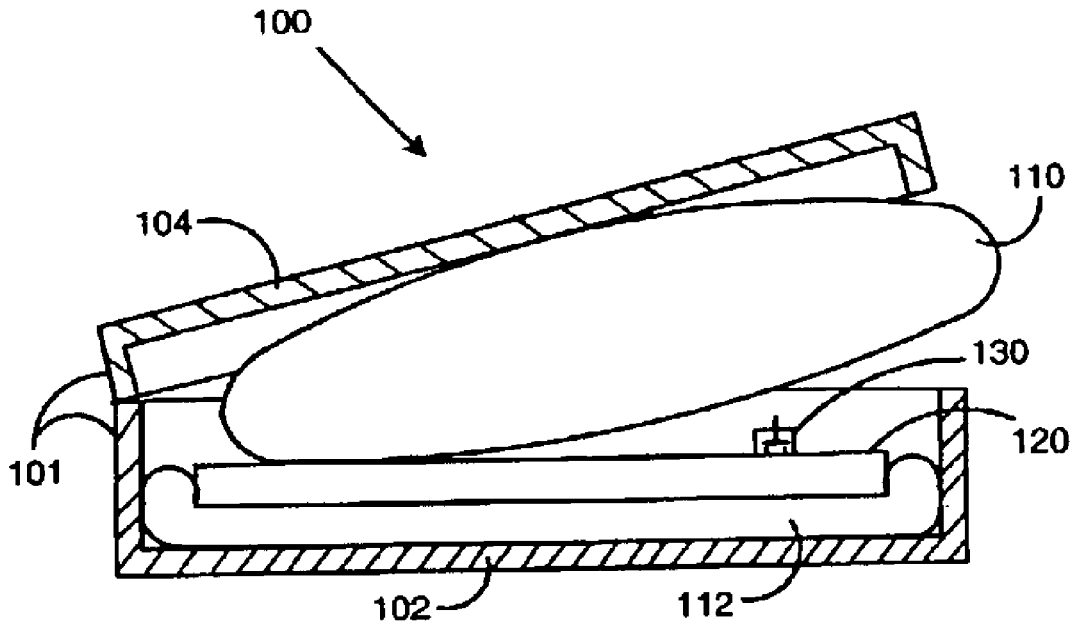
FIG. 1 is a perspective view of a side cutaway of a tamper-detecting device according to an illustrative embodiment of the present application.

Referring to FIG. 1, an active tamper detection device according to an illustrative embodiment of the present application is described. This embodiment may provide a lower cost tamper detection and response system than conventional mesh systems. A system of gas or liquid filled bags or balloons fills the gaps between a circuit board and the surrounding enclosure. The circuit board includes mechanical switches that are closed by the pressure of the fluid of gas in the bag. If the cover is opened, or the bag is punctured, the bags at least partially deflate and the switches will open and trigger the active tamper detection circuitry. Such modules 120 may be subject to attack.

Tamper Detection Device 100 includes an outer shell 101 of aluminum or other suitable material such as plastic. The outer shell has two portions, an upper portion 104 and a lower portion 102 that are connected using internal spring latches intended to be closed only once.

A lower balloon 112 is constructed of Mylar and inflated with argon. An upper balloon 114 is constructed of Mylar and inflated with argon. The module 120 is an enclosed circuit attached to at least one tamper detection switch 130 that is a normally opened switch that is biased closed by the balloons in normal operation. The switch is opened if the device is attacked. Here, the device 100 is shown opened in a state that might occur during an attack. As the lid 104 is pried off the device 100, the upper balloon 110 escapes at least partially out of the enclosure and activates switch 130 to release into the normally open position which activates the tamper detection interrupt or circuit that can trigger a response.

The electronic module 120 may have many different configurations including one having a printed circuit board with components such as integrated circuits and discrete components and a battery. The printed circuit board is covered so as to protect the tamper detection bags 110, 120. Alternatively, the module 120 may be hermetically sealed and may also be enclosed such as in an epoxy or metal enclosure.

The module 120 may utilize Radio Frequency communications to communicate with the outside world so that an external wired connection through shell 101 is not necessary. Alternatively, any radiation source including sound could be used to form a communications channel from the module to the world outside of the outer enclosure 101. In an alternative, a ribbon cable or other connection may be used to connect the module to devices outside of the outer enclosure 101. In another alternative, portions of the outer enclosure may be used as communications channel connections or other connections to the module 120. The outer enclosure 101 may include one or more electrically conductive areas that are insulated from each other.

In another alternative, the module 120 may include a smart card. While the module 120 is powered by an internal battery, external power could be provided using a direct connection or by using an inductive or other wireless connection. For example, external RF energy could power a device in a similar manner to the power source used for a passive RF-ID tag. Additionally, if external power is used, a relatively small power source could be included in the module to power the tamper detection and tamper response circuitry.

The tamper detection switch may be used to trigger a tamper response circuit. Here, the module 120 includes a non-volatile or volatile memory such as an electronic memory. The electronic memory includes a flash memory or portion of a flash memory that is used to store sensitive information such as a cryptographic key. The tamper detection device causes an erase circuit to erase or write over at least a part of the sensitive information so that the attacker cannot obtain it. The tamper detection is a mechanical switch, but alternative switches may be used. Furthermore, the balloon inflation material may include material that completes a circuit to detect tamper if it is released from the balloon.

Here, the erase circuit may utilize a processor or other controller in the non-tamper related module 120 circuit, and may include an 8051 compatible processor. However, the erase circuit may also include a separate erase state machine or processor to erase the flash memory independently of the 8051 processor or other non-tamper related circuitry. In such an alternative, the tamper response circuit may include a separate power supply.

In an alternative, a second sensitive memory store is provided for a value register such as a postage value in a postage vault that is used in a postage meter. Postage meters including postage vaults are available from Pitney Bowes Inc. of Stamford Conn. In such a device, the module 120 may include a second memory store for the postage value and a third memory store for storing an encrypted version of the postage value that is encrypted using a second key that is stored in a fourth memory and known only to the postage meter company. In such an alternative, the second memory having the plaintext postage value and the keys stored in the first and fourth memory locations are erased if a tamper condition is detected. However, the postal meter company can later recover the third memory including the encrypted postage value because it maintains a copy of the symmetric key that was stored in the fourth memory. In an alternative, a public key/private key may be used instead of the symmetric key of the fourth memory. Of course the memory stores may be in the same device, different devices or stored in memory devices in groups of one or more.

The tamper response circuit may also be used to react to a loss of power condition or other out of specification environmental condition such as an out of range temperature provided that the appropriate sensors are available in the device.

The outer enclosure 101 is constructed of aluminum. However, other materials including steel, plastic, ceramic and epoxy may be used. For example, a cold pour polyurethane system with a relatively short cure time period could be used to form all or part of the outer enclosure 101. For example, a top portion of the outer enclosure 101 may be formed using an epoxy. In an alternative, an epoxy that adheres to the balloon is used so that removal of any part of the epoxy will burst the balloon. Other known delaminating detection methods may also be utilized. The outer enclosure may be a clamshell configuration and may have a flexible tab used to secure two or more portions of the outer shell to complete the device. The outer shell of this embodiment is constructed using aluminum, but many known suitable enclosure materials such as a plastic material may be utilized.

Figure 2:
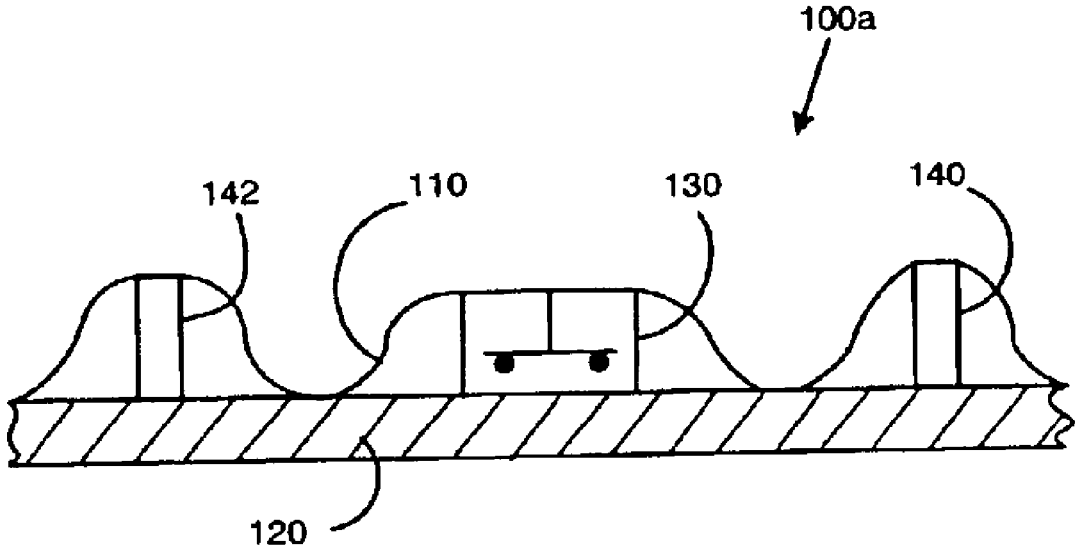
FIG. 2 is a perspective view of a partial side cutaway of a tamper-detecting device having switch wall protectors according to an illustrative embodiment of the present application.

Referring to FIG. 2, another alternative illustrative embodiment according to the present application is described. Device 100*a* includes a circuit module 120 connected to tamper detection switch 130. The module 120 is also connected to probe barrier walls 140, 142 that the upper balloon 142 forms around. Here a probe from the outside will not be able to reach the switch without penetrating walls 140, 142.

Figure 3:
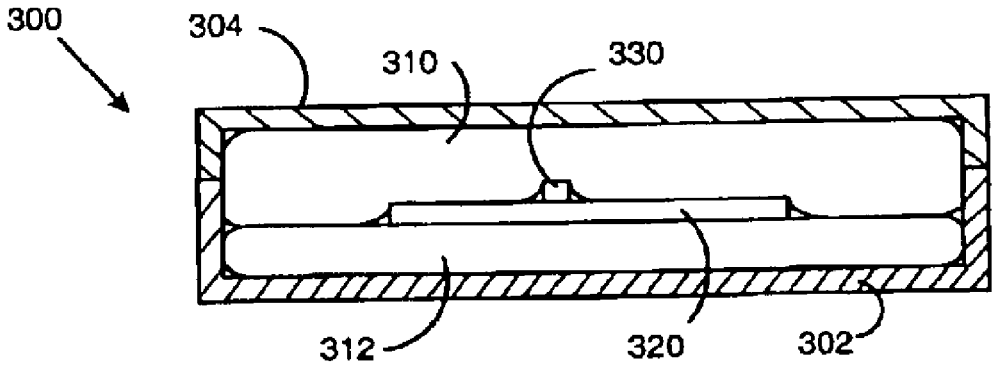
FIG. 3 is a perspective view of a side cutaway of a tamper-detecting device according to another illustrative embodiment of the present application.

Referring to FIG. 3, another alternative illustrative embodiment according to the present application is described.

Device 300 includes an outer shell 302, 304 of plastic or other suitable material such as epoxy. The outer shell includes two portions, an upper portion 304 and a lower portion 302 that are joined with adhesive.

A lower balloon 312 is constructed of Mylar and inflated with distilled water. An upper balloon 310 is constructed of Mylar and inflated with distilled water. The module 320 is an enclosed circuit attached to at least one tamper detection switch 330 that is a normally opened switch that is biased closed by the balloons in normal operation and opened if the device is attacked. Here, the device 300 is shown in a closed state that should indicate normal operation. The balloons 310, 312 are glued to the inside surface of the outer enclosure 304, 302. If any part of the outer enclosure is removed, the balloon will rupture and the tamper will be detected. In an alternative, a conductive liquid is used to inflate the balloons and the tamper detection device includes a circuit that is completed by the conductive liquid if it is released from the balloon.

Figure 4:
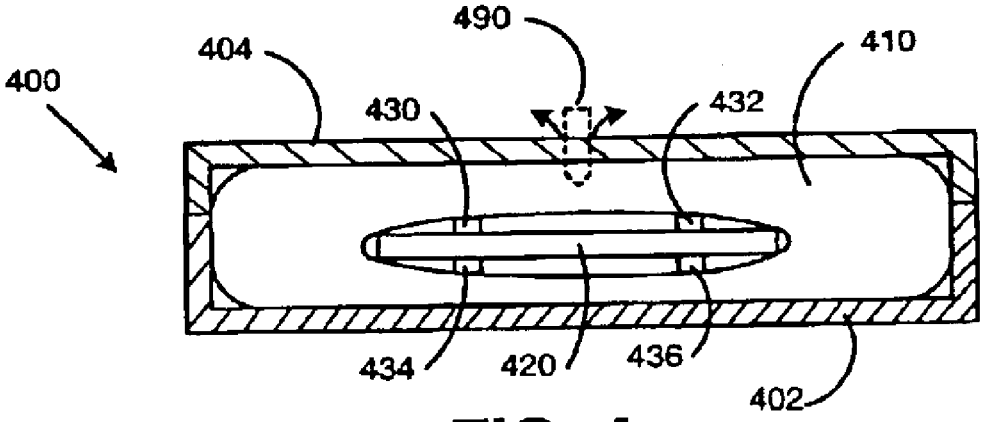
FIG. 4 is a perspective view of a side cutaway of a tamper-detecting device having a single balloon according to another illustrative embodiment of the present application.

Referring to FIG. 4, another alternative illustrative embodiment according to the present application is described.

Device 400 includes an outer shell 402, 404 of plastic or other suitable material such as aluminum. The outer shell has two portions, an upper portion 404 and a lower portion 402 that are connected with adhesive.

A single tubular balloon 410 is constructed of Mylar and inflated with argon. Balloon 410 is sealed after insertion of the electronics module 420. The module 420 communicates with the outside world using an RF radio such as a Bluetooth TM device.

The module 420 is an enclosed circuit attached to at least four tamper detection switches 430, 432, 434, 436 that are normally opened switches that are biased closed by the balloon 410 in normal operation and opened if the device is attacked. Here, the device 400 is shown in a closed state that should indicate normal operation, but with an attack in progress. The attacker probe 490 has penetrated the outer enclosure 404 and punctured the balloon 410. The argon then escapes into the atmosphere and switches 430, 432, 434, 436 detect the attack. An appropriate response is then initiated.

Figure 5:
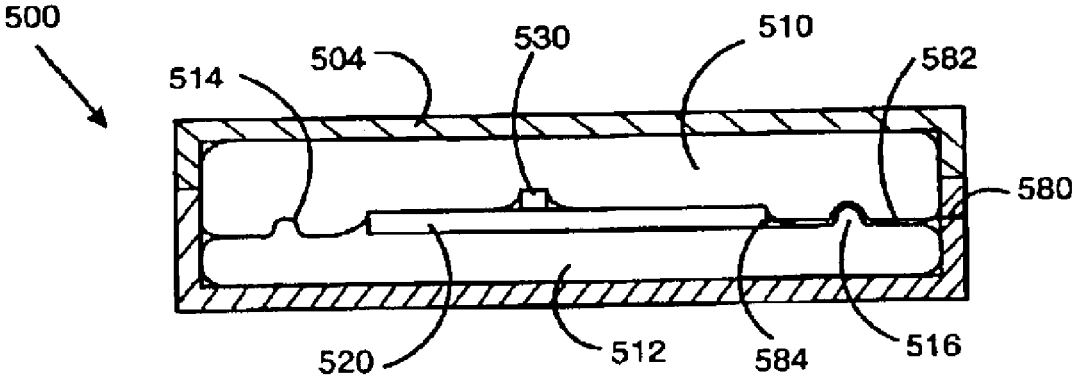
FIG. 5 is a perspective view of a side cutaway of a tamper-detecting device having an external wire connection and a seam bulge to another illustrative embodiment of the present application.

Referring to FIG. 5, another alternative illustrative embodiment according to the present application is described. Sensitive device 500 includes a two part outer cover 504 that is aluminum. Other materials such as plastic, ceramic or steel may be used. A lower balloon 512 is constructed of Mylar and inflated with argon. An upper balloon 514 is constructed of Mylar and inflated with argon. The module 520 is an enclosed circuit attached to at least one tamper detection switch 530 that is a normally opened switch that is biased closed by the balloons in normal operation and opened if the device is attacked.

Balloons can be formed so that certain sections will retain a shape. As shown in FIG. 5, this characteristic of balloons can be used for added tamper protection. Bulges 514 and 516 are formed into the lower balloon 512. When inflated, the bulges provide a non-linear seam between the upper balloon 510 and the lower balloon 512. Here, if an attacker probed the seam between the upper balloon 510 and the lower balloon 512 on the left side of the enclosure, the probe would encounter an edge of lower balloon 512 at bulge 514 that was taught and likely to rupture if probed.

In this embodiment, an external physical connection is provided by ribbon cable 582 that is connected to the electrically conductive contact 580 that is insulated from the rest of enclosure 504. The ribbon cable 582 is connected to module 520 at strain relief 584. Strain relief 584 also provides a tamper detection switch. If an attack is detected, the device provides a tamper response as discussed herein.

Figure 6:
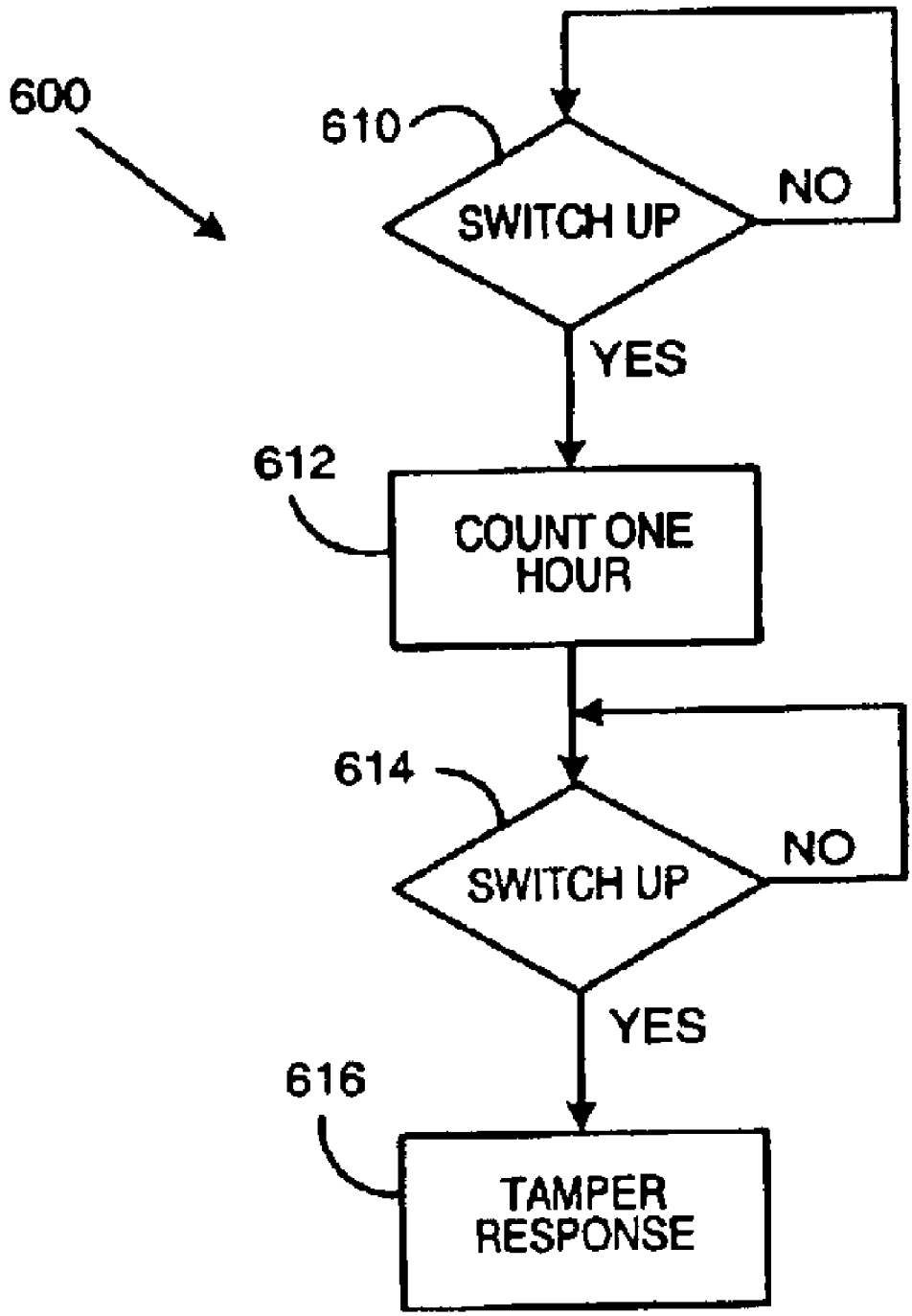
FIG. 6 is a flowchart showing an assembly process for a tamper-detecting device according to an illustrative embodiment of the present application.

Referring to FIG. 6, processes for manufacturing a device according to illustrative embodiments of the present application are shown involving assembly and installation steps.

During manufacture, there may be a need to have the module completed with the battery installed. In the assembly process, there may be an assembly mode that may be used for assembly and test and then a normal mode that is used to detect tampering. For example, the device may need to be tested. Accordingly, the switches such as switch 130 will be in an open state before being inserted into the outer enclosure and the tamper bags installed.

Referring to FIG. 6, a process 600 for assembling the device 100 according to an illustrative embodiment of the present application is shown. In one alternative, the switches may be taped down until installation and then after the tape is removed, the tamper detection circuit enters a one-time delay to enable the bags to be installed and the outer enclosure completed before entering the tamper detection state. In step 610, the tamper state machine is in a tight loop until the first time the switch goes up. The process is interrupt-based, but may use a message system in the event of a switch up condition. In step 612, the tamper circuit enters a one-hour countdown to allow for manufacture. Then in step 614, the device enters the normal tamper mode that if triggered proceeds to step 616 for tamper response. In an alternative, the countdown may include an audio/visual or other signal indication of the countdown. The system is preferably designed so that it may be reloaded with keys at the factory so that a delayed assembly will not destroy the device.

In another alternative, a process assembling the device 100 according to another illustrative embodiment of the present application may utilize assembler codes so that the switches do not have to be taped down. For example, a switch depress followed by one to two seconds and then another switch depress may signal the start of assembly. The same code may be used to reset the assembly timer and another may be used to halt the timer. In another alternative, the device may provide an audio, visual or other indication of the state of the installation assembly procedure.

Figure 7:
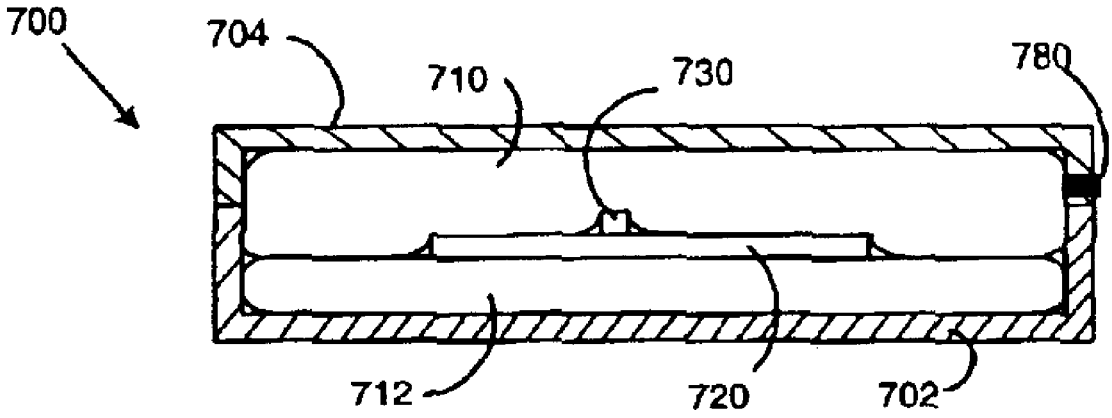
FIG. 7 is a perspective view of a side cutaway of a tamper-detecting device according to another illustrative embodiment of the present application.

Referring to FIG. 7, another alternative illustrative embodiment according to the present application is described. Device 700 includes an outer shell 702, 704 of plastic or other suitable material such as epoxy. The outer shell has two portions, an upper portion 704 and a lower portion 702 that are connected with adhesive. A lower balloon 712 is constructed of Mylar and inflated with distilled water. An upper balloon 714 is constructed of Mylar and is not initially filled. The module 720 is an enclosed circuit attached to at least one tamper detection switch 730 that is a normally opened switch that is biased closed by the balloons in normal operation and opened if the device is attacked. Here, the device 700 is shown in a closed state that should indicate normal operation. The upper balloon 710 is filled with a gas such as argon by using filling portion 780 in the upper enclosure 704 after enclosure halves 702, 704 have been joined. In an alternative, both balloons 710, 712 can be filled after the enclosure is sealed by using a filler portion that allows the balloon to be filled and then seals the balloon using an epoxy or heat to seal the plastic. Once the balloon 710 is filled, the switch is depressed and the tamper detection circuit enters the state of detecting intrusion.

In an alternative applicable to any of the embodiments described above, normally closed switches may be used that are opened when the bag or balloon is breached or unsettled.

It is likely that devices including sensitive modules 120 that present fraud opportunity and are not too scarce will be subject to a first destructive attack so that the attacker can investigate the device before embarking on the actual attack of another device. Accordingly, in an alternative manufacturing process, at least several different configurations are utilized so that the locations of the switches vary between at least certain groups of units and so that any seams between bags may similarly be varied.

The tamper detection switch is used to trigger an interrupt that may require less power than a polling routine. However, a polling routine may be used to monitor the switches.

The bags or balloons described can be constructed using many materials and may be constructed of Mylar and inflated with a large molecule gas such as Argon so that the balloon will remain inflated for long periods of time. Other balloons and inflation materials may be used. For example, latex or other material that would respond to an attack could be utilized. Natural rubber latex may be used or a synthetic material may be used. For example, the balloon should burst if a penetration attack is attempted. In an alternative, the bags 110, 112 are glued to the inside cover of the outer enclosure 101 so that the balloon will burst if any part of the outer enclosure is removed. In certain embodiments, the balloons are taught such that an attack will more easily rupture the balloons. However, in another alternative, a fulcrum balloon material such as that used in an intravascular catheter is utilized so that the balloon will expand if any part of the outer enclosure is removed. Other catheter balloon materials may also be utilized. In one alternative, elastic polymers are used so that the balloon more easily escapes from any hole in the outer enclosure and thereby triggering the tamper switch.

The balloons may be inflated with a gas such as air or liquid such as a gel that would escape if the balloon is punctured. The balloons may be required to maintain inflation pressure for long periods, so a large molecule gas such as Argon may be used instead of air. Additionally, the balloons may use low pressure and the switches responsive to a relatively low pressure so that leakage is minimized. In an alternative, a liquid or gel is used to inflate the balloons. A liquid or gel that would expand when frozen is used so that a cold temperature attack would not defeat the device.

In an alternative that uses a liquid for one or more bags or balloons according to the embodiments of the present application, an abundant, readily available liquid such as water may be used. However, a fluid designed to provide tamper response could be used. For example, a conductive liquid could be used to short a circuit in order to destroy it. Alternatively, a dye could be used to indicate a tamper attempt. Other fluids such as those that would damage the enclosed circuitry may be used.

In another alternative, the device is constructed in a vacuum with a switch that will close under very little pressure in order to detect tamper. However, an attack on such a device could be attempted in a vacuum environment.

In an alternative applicable to any of the embodiments, a second switch or set of switches is used that are normally open under the normal operating pressures of the device. An attack on the device may attempt to pierce the balloon with a self sealing probe. In this alternative embodiment, at least some added pressure should result and the secondary switches would detect the tamper and could respond such as described above by erasing memory locations.

The present application describes illustrative embodiments including those for a system and method for tamper detection. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. A tamper detecting apparatus comprising:

an outer enclosure having at least one portion providing a substantially continuous and contiguous outer surface without any opening when assembled for completely surrounding and fully enclosing a an electronic module including a memory for storing sensitive data;

at least one switch positioned inside the outer enclosure for detecting a tamper condition; and at least one balloon inflated with inflation material positioned inside the outer enclosure for biasing the at least one switch to a first position during normal operation and for releasing the switch to a second position during an attack condition.

2. The apparatus of claim 1 further comprising:

at least one probe barrier wall between the outer enclosure and each of the at least one switches.

3. The apparatus of claim 1, wherein the at least one switch is operatively connected to a tamper detector circuit that is operatively connected to a tamper response circuit, wherein the tamper response circuit erases at least a portion of the sensitive data stored in the memory after the tamper condition is detected.

4. The apparatus of claim 1, wherein the at least one balloon envelopes the module and switch.

5. The apparatus of claim 1, wherein the at least one balloon comprises a lower balloon and an upper balloon.

6. The apparatus of claim 5, wherein the lower balloon comprises at least one bulge that during the normal operation is displaced in an indent of the upper balloon.

7. The apparatus of claim 1, wherein the module comprises a non-volatile memory, the sensitive data comprises cryptographic information;

the outer enclosure comprises epoxy; and at least a portion of an outer surface of the balloon is adhered to at least a portion of an inside surface of the outer enclosure.

8. The apparatus of claim 3, wherein the module comprises a non-volatile memory; and the sensitive data comprises postage value information.

9. The apparatus of claim 1, wherein the at least one switch is a normally opened switch.

10. The apparatus of claim 1, wherein the at least one balloon comprises Mylar.

11. The apparatus of claim 1, wherein the inflation material comprises argon.

12. The apparatus of claim 1, wherein the inflation material comprises a large molecule gas.

13. The apparatus of claim 1, wherein the inflation material comprises air.

14. The apparatus of claim 1, wherein:

the outer enclosure is hermetically sealed.

15. A method for assembling a tamper-detection enclosure having an outer shell, at least one inflated balloon and at least one switch comprising:

switching the switch into a tripped position thereby starting a timer and commencing an assembly mode whereby the tripped position is ignored for a first timed period;

installing the inflated balloon within the first timed period, thereby switching the switch into a non-tripped position; and completing the outer shell, thereby completely enclosing the at least one inflated balloon and the at least one switch.

16. The method of claim 15, further comprising:

removing a restraint from the switch.

17. The method of claim 15, wherein:

the first timed period is one hour.

18. The method of claim 15, further comprising:

installing an electronic device into the enclosure; and entering an assembly start code into an electronic device.

19. The method of claim 18, wherein:

the assembly start code is entered using the switch.

20. A tamper detecting device comprising:

an outer enclosure having at least one portion providing a substantially continuous and contiguous outer surface without any opening when assembled for completely surrounding and fully enclosing an electronic module including a memory for storing sensitive data;

means for detecting a tamper condition;

means for providing an assembly period for setting the means for detecting a tamper condition, wherein detected tamper conditions will be ignored during the assembly period; and at least one balloon inflated with inflation material for triggering the means for detecting a tamper condition.

* * * * *